United States Patent [19]

Hotier et al.

[11] Patent Number: 4,784,753

[45] Date of Patent: Nov. 15, 1988

[54] DEASPHALTING PROCESS COMPRISING POWER RECOVERY FROM THE STAGE OF SEPARATING DEASPHALTED OIL FROM THE DEASPHALTING SOLVENT

[75] Inventors: Gérard Hotier, Rueil Malmaison; Pierre Renard, Saint Nom la Breteche, both of France

[73] Assignee: Institut Francais du Petrole, Rueil-Malmaison, France

[21] Appl. No.: 920,090

[22] Filed: Oct. 17, 1986

[30] Foreign Application Priority Data

Oct. 17, 1985 [FR] France ..... 85 15552

[51] Int. Cl.[4] ..... C10C 3/00

[52] U.S. Cl. ..... 208/309; 208/353; 208/251 R; 208/45

[58] Field of Search ..... 208/309, 353

[56] References Cited

U.S. PATENT DOCUMENTS

| | | | |
|---|---|---|---|
| 2,616,912 | 11/1952 | Dickinson | 208/309 |
| 2,940,920 | 6/1960 | Garwin | 208/86 |
| 3,202,605 | 8/1965 | Redcay | 208/309 |
| 4,125,458 | 11/1978 | Bushnell et al. | 208/309 |
| 4,201,660 | 5/1980 | Zosel | 208/86 |
| 4,305,814 | 12/1981 | Leonard | 208/309 |
| 4,341,619 | 7/1982 | Poska | 208/390 |
| 4,349,415 | 9/1982 | DeFilippi et al. | 208/353 |
| 4,354,922 | 10/1982 | Derbyshire et al. | 208/309 |
| 4,363,717 | 12/1982 | Pelrine et al. | 208/309 |
| 4,395,330 | 7/1983 | Auboir et al. | 208/309 |
| 4,421,639 | 12/1983 | Lambert et al. | 208/309 |
| 4,478,705 | 10/1984 | Ganguli | 208/96 |
| 4,482,453 | 11/1984 | Coombs et al. | 208/309 |
| 4,493,765 | 1/1985 | Long et al. | 208/309 |
| 4,502,944 | 3/1985 | Nelson | 208/309 |
| 4,547,292 | 10/1985 | Zarchy | 208/309 |

FOREIGN PATENT DOCUMENTS

| | | | |
|---|---|---|---|
| 639896 | 4/1962 | Canada | 208/309 |

OTHER PUBLICATIONS

*ROSE Process Improves Resid Feed,* Hydrocarbon Processing, May 1976, Gearhart et al, pp. 125–128.

*Unit Processes and Principles of Chemical Engineering,* Crosbyfield et al, D. Van Nostrand Co., Inc (pp. 1–3) 1932.

*Primary Examiner*—H. M. S. Sneed

*Assistant Examiner*—Helane Myers

*Attorney, Agent, or Firm*—Millen & White

[57] ABSTRACT

In a deasphalting process wherein the deasphalted oil is separated from the deasphalting solvent, the invention consists of performing said separation in at least two separate steps, differing by their temperatures, and of recovering heat from the deasphalted oil.

The oil to be deasphalted (26) passes through an extractor (1), then through heat recuperators (3) and (4). The oil-solvent separation is achieved in two steps (5) and (11), under supercritical conditions, at different temperatures. The process has the particular advantage of saving power since external heat is provided (10) to only part of the charge.

9 Claims, 4 Drawing Sheets

DEASPHALTING PROCESS COMPRISING POWER RECOVERY FROM THE STAGE OF SEPARATING DEASPHALTED OIL FROM THE DEASPHALTING SOLVENT

The invention concerns a deasphalting process comprising power recovery during the separation of deasphalted oil from deasphalting solvent.

BACKGROUND OF THE INVENTION

As early as 1960, U.S. Pat. No. 2,940,920 disclosed the separation of deasphalting solvent from deasphalted oil under supercritical conditions for the solvent (supercritical is intended to mean a pressure higher than the critical pressure and a temperature higher than the critical temperature; the critical temperature is the maximum temperature at which at least a part of the fluid can be liquefied by isothermal compression; the critical pressure is the maximum pressure at which condensation or boiling occurs by temperature variation at constant pressure).

For example, this patent specification, at column 18, line 20, discloses the separation of normal pentane, on the one hand, from deasphalted and deresined oil, on the other hand, at a temperature of 215° C. and at a pressure of 37.5 bars, whereas the critical temperature and pressure of pentane are respectively 196° C. and 33 bars.

It can be observed that this patent also discloses deresining of deasphalted oil under supercritical conditions for the solvent.

U.S. Pat. No. 4,305,814 extends this technique to the solvent-asphalt separation and to the solvent-resin separation: the oil to be treated is contacted, in a first settler, with solvent and an oil-resin-solvent mixture is separated from asphalt which still contains some solvent. In a first step, the asphalt+solvent mixture is brought to supercritical conditions for the solvent and there is separated, on the one hand, substantially pure solvent and, on the other hand, asphalt containing solvent traces which will then be stripped with steam. The oil-resin solvent mixture is so heated as the bring it to conditions which may be slightly supercritical; a solvent-oil mixture is separated from resin still containing solvent. In a second step, the resin+solvent mixture is heated to supercritical conditions for the solvent whereby additional solvent can be recovered before stripping the last solvent traces from the resin fraction. Finally, the oil-solvent mixture is heated so as to bring it to supercritical conditions before separating most of the solvent from the oil.

In the mentioned example, the deasphalting solvent is penetane, the conditions in the first step are 238° C., 46.4 bars and the conditions in the second step are 240° C., 46 bars.

U.S. Pat. No. 4,502,944 discloses deasphalting and deresining in a single step with demixing to 3 liquid phases, at a temperature of about 15°–20° C. lower than the solvent critical temperature and at a pressure about 20 bars higher than the critical pressure. The lighter phase, consisting of a solvent-oil mixture, is passed through an exchanger and through a furnace before entering a supercritical separator at a pressure equivalent to that of the first separator (with the approximation of the pressure drops) and at a temperature higher than the critical temperature of the solvent, not specified. Then the separated solvent passes through the above-mentioned exchanger and heats the oil-solvent mixture.

In the three above-mentioned patents, to steps conducted under supercritical conditions are destined to separate the deasphalted oil from the deasphalting solvent.

This is diagrammatically expressed as follows:

| "cold" extraction step by undercritical liquid solvent | "hot" step of supercritical solvent separation |
|---|---|

It is thus desired, in a first type of process according to these documents, to minimize the amount of matter stripped with the supercritical fluid. In other documents, for example in U.S. Pat. Nos. 4,201,660, 4,478,705, 4,363,717, 4,341,619, 4,482453, 4,349,415 and 4,354,922, the operating principle is of a second type which can be considered as the inverse: it is first desired to strip, from a substance to be refined, a class of components which will dissolve into the supercritical phase and then, during a second expansion and/or heating stage, to separate the solvent from the stripped extract, this being diagrammatically expressed as follows:

| 1 - High pressure supercritical extraction step | 2 - Low pressure separation step under critical or slightly supercritical conditions |
|---|---|

or by succession of:

1—High pressure supercritical extraction

2—Release of a part of the stripper matter by heating (supercritical conditions)

3—Undercritical low pressure separation.

In this second type of scheme, the object is to maximize the amount of matter stripped with the supercritical fluid.

SUMMARY OF THE INVENTION

The present invention concerns processes of the above-mentioned first type and provides a method for increasing to a maximum extent the power recovery during supercritical separation of deasphalted oil from the deasphalting solvent. The deasphalting solvent comprises at least one hydrocarbon having 3 to 6 carbon atoms and pertains, for example, to the group formed of $nC_3$, $nC_4$, $nC_5$, $nC_6$, $iC_4$, $iC_5$, neo $C_5$, iso $C_6$, propylene, butenes, pentenes, hexanes or to the group of propane, butane, pentane, hexane, or to a $C_3$ cut, $C_4$ cut, $C_5$ cut, $C_6$ cut, propylene cut, butene cut, which cuts are formed of a mixture of the above-mentioned pure products.

The deasphalted oil originates either from deasphalting or from deasphalting followed with deresining, by means of one of the above-mentioned solvents, of heavy oil products such as straight-run residue, vacuum residue, topped heavy crude oils, residues from catalytic cracking, coal or oil tars, said list being non-limitative. The solvent/oil volume ratio, called solvent ratio in a deasphalting or deresining operation, is mostly from 3/1 to 10/1.

The present invention is applicable preferably when the supercritical separation is diphasic. The two separated phases may be considered as two liquids, or as a vapor and a liquid, or as a liquid and a so-called supercritical fluid phase, with reference to the deasphalting solvent. As a matter of fact, it is known (Zhuze Petroleum 1960-23-298) that certain conditions close to the critical point of the solvent may give rise to triphasic "vapor-liquid of low oil content-liquid of high oil content" balances.

Hence the invention has as a main object the minimization of power consumption in deasphalting processes. The proper deasphalting step is not changed as compared with the prior art. Hence, the charge is contacted with the deasphalting solvent preferably at an average temperature at most equal to the critical temperature of the solvent. A novel improvement with respect to the prior art concerns the step of fractionating the extract, whereby deasphalted oil and the deasphalting solvent can be recovered separately.

In order to avoid triphasic separation, on the one hand, and to achieve diphasic separation in the most selective way possible, on the other hand (the phase of low oil content must contain a maximum of 7.5% by weight of oil, the phase of high oil content must contain at least 50% by weight of oil), the operation is conducted as follows: the raw extract originating from the solvent extraction unit is first brought, in at least a first step, to supercritical conditions, at least with respect to the solvent, comprising a temperature $T_1$ and a pressure $P_1$, so as to produce a separation into two phases, a first phase of recovered solvent and a first extract phase of increased oil content; these two phases are separated and, in at least a second step, the first extract phase of increased oil content, obtained in the first step, is brought to super critical conditions (at least with respect to the solvent) of temperature $T_2$ and pressure $P_2$, so as to produce a separation into two phases, a second phase of recovered solvent and a second extract phase of increased oil content, these two phases being separated.

In the first step, 75 to 97% of the solvent contained in the raw extract is recovered and 50 to 80% of the solvent of the first extract phase of increased oil content is recovered in the second step.

At least a part of the heat of external origin used in the two above-mentioned steps is supplied in the second step, and at least a portion of the heat required for the first step is supplied by heat recovery from the first phase of recovered solvent.

$T_1$, $T_2$, $P_1$ and $P_2$ are defined as follows:

$$T_c+1.5x^2-2x<T_1<T_c+1.5x^2-2x+45 \quad (1)$$

wherein $T_c$ is the critical temperature of the deasphalting solvent and x the number of carbon atoms of the elementary molecule of deasphalting solvent; these formulas are calculated in Celsius degrees. When the deasphalting solvent is a mixture, $T_c$ is the temperature wherefrom it is no longer possible to liquefy the whole mixture, irrespective of the pressure, and x is the average number of carbon atoms of the solvent molecules.

$$P_c+5<P_1<P_c+30 \quad (2)$$

wherein $P_c$ is the critical pressure of the deasphalting solvent (the pressures are calculated in absolute bars); when mixtures are concerned $P_c$ represents, at temperature $T_c$, the pressure at which the first vapor bubble appears. By way of illustration, the operating ranges for normal hydrocarbons are as follows:

| | $T_1$min. | $T_1$max. | $P_1$min. | $P_1$max. |
|---|---|---|---|---|
| Propane | 104° | 147.5° | 48 bars | 78 bars |
| Butane | 150° | 194° | 42 bars | 72 bars |
| Pentane | 224° | 268.5° | 38 bars | 63 bars |
| Hexane | 277° | 323° | 34 bars | 64 bars |

$$T_1+20<T_2<T_1+80 \quad (3)$$

wherein $T_1$ is the operating temperature of the first supercritical separation (a), the temperaturesbeing expressed in Celsius degrees:

$$P_c<P_2<P_1+20 \quad (4)$$

wherein $P_c$ is the critical pressure of the solvent, expressed in absolute bars. Between the output of the deasphalting stage and the two supercritical separation stages, the heat exchanges are performed as explained hereinafter.

In a preferred embodiment, the heat necessary for increasing the temperature of the raw extract to that required for the phase separation in the first step is supplied to said extract in the following order:

first, the heat of the first recovered solvent phase, then, the heat of the second extract phase of increased oil content.

Eventually, additional heat may be supplied from an external heat source.

An operating example may comprise:

a first separation (a), followed by a second separation (b1) applied to the phase of high oil content obtained from (a), a first separation (a), followed by a combination (b3) of a recompression (b2) of the phase of low oil content obtained from (a) with a second separation (b1) applied to the phase of high oil content obtained from (a).

a first separation (a) followed by a combination (b4) of a second separation (b5) applied to the phase of low oil content obtained from (a) with a second separation (b1) applied to the phase of high oil content obtained from (a).

The recompression of the supercritical solvent (b2), when performed, is conducted preferably adiabatically (without heat exchange) so that its temperature increases by at least 15° to 20° C., in order to obtain an economical heat recovery.

It will be thus possible to recover, as a maximum, by charge-effluent exchange, the heat of the "supercritical" solvent and then, after expansion, hence cooling to the initial temperature of the deasphalting unit, to feed back the purified solvent to the deasphalting stage.

b-3 This step is a combination of the second step of supercritical separation (b1) conducted at a temperature higher than that of the first supercritical separation step, on the one hand, with, on the other hand, a recompression of the "vapor" (b2) or, more generally, of the supercritical solvent obtained from the first supercritical separation step.

b-4 Before this step, the separation (a) is conducted at a temperature preferably ranging within the lower quarter of the temperature range defined above for $T_1$. During proper step (b4) the phase of high oil content obtained in (a) is subjected to a second separation similar to that described in (b1), conducted at a temperture preferably within the upper quarter of the temperature range defined above for $T_2$. The phase of low oil content obtained from said second separation step is admixed with the phase of low oil content obtained from separation (a), thereby increasing its temperature. This mixture of low oil content is subjected to a second separation similar to that described in (b1), conducted preferably at a temperature within the lower quarter of the temperature range defined above for $T_2$. Finally, the phase of high oil content obtained from said separation is preferably recycled to step (a).

BRIEF DESCRIPTION OF THE DRAWINGS

The principle of the invention will become clearly apparent from the accompanying drawings and explanations relating thereto.

The reference numerals throughout all the drawings refer to the same parts unless specifically indicated to the contrary.

Figure 1:
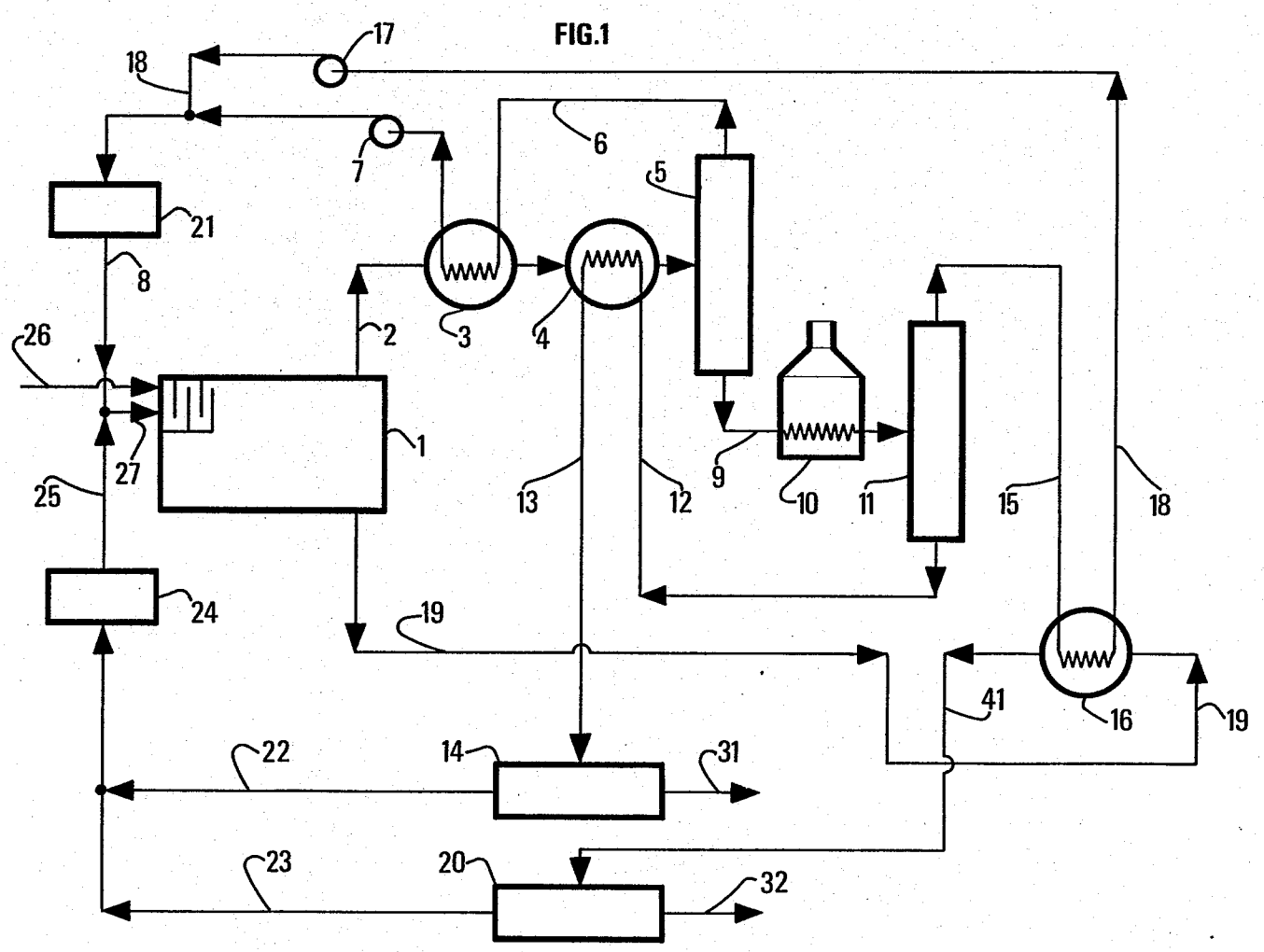

In these drawings,

FIG. 1 illustrates a first embodiment of the invention where the supercritical separation is performed in two steps.

Figure 2:
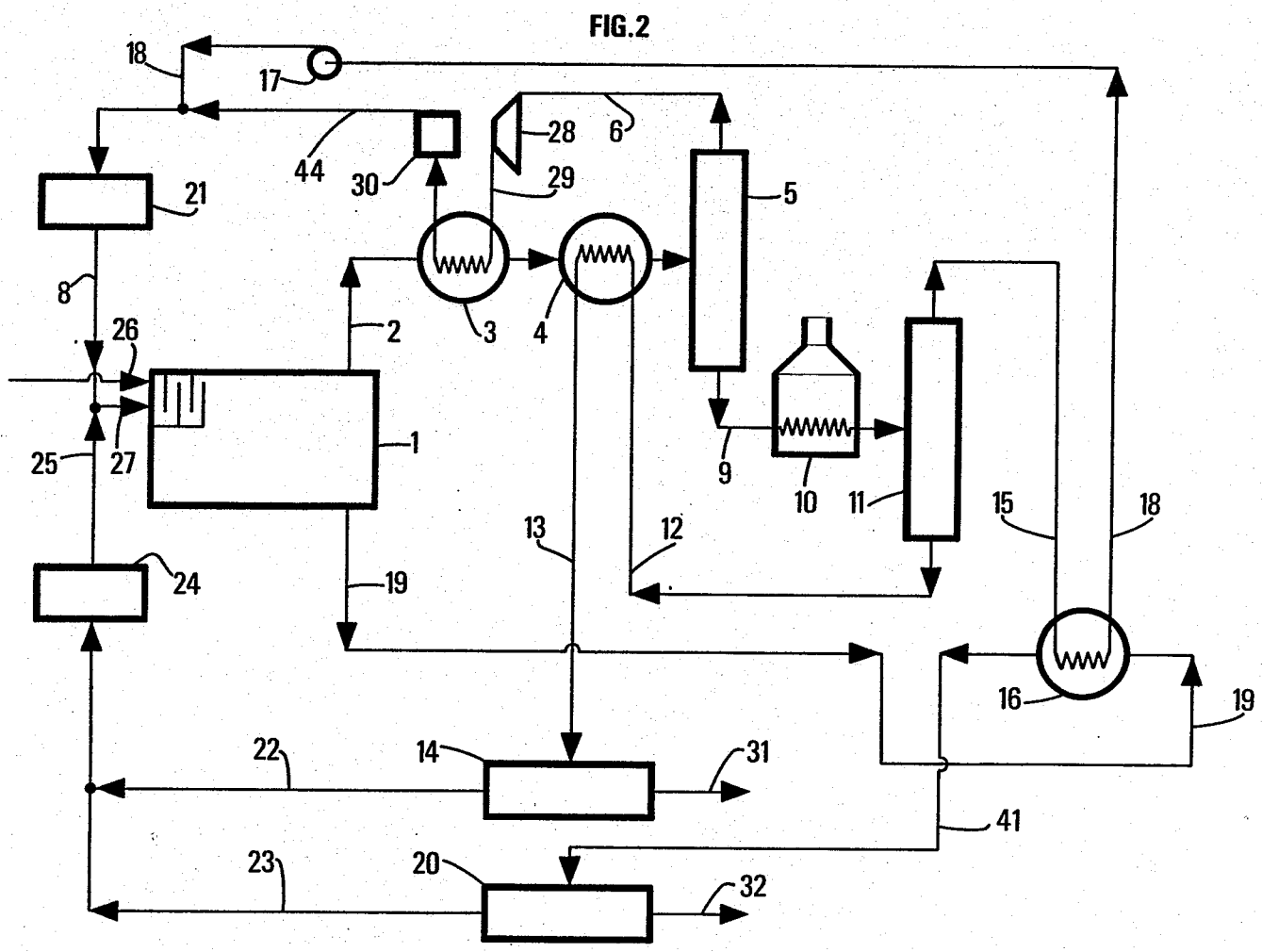

FIG. 2 illustrates a supercritical separation in two steps combined with a recompression of the supercritical fluid.

Figure 3:
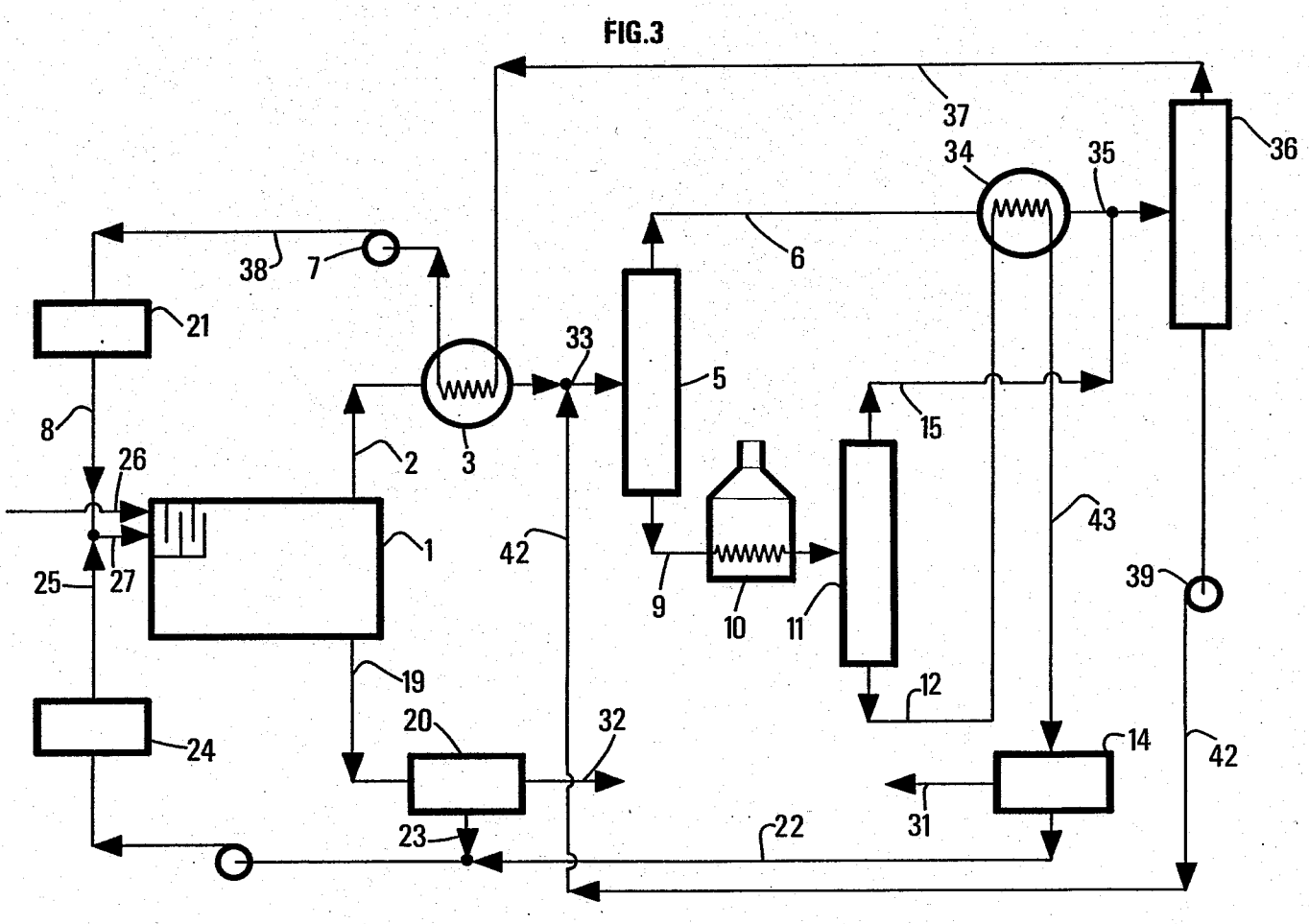
Figure 4:
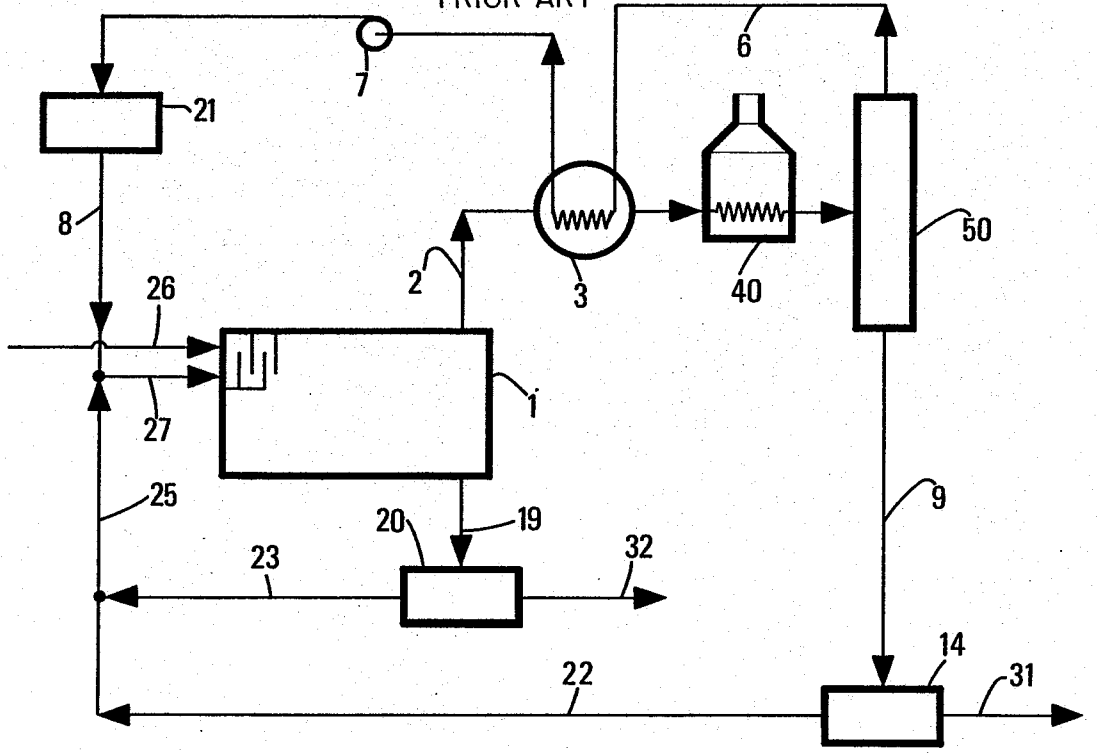
FIG.4 PRIOR ART

FIG. 3 illustrates a preferred embodiment of the invention wherein the solvent ratio is higher than 8, and FIG. 4 illustrates the prior art.

Referring again to FIG. 1, the residue is supplied through line 26 and the solvent through line 27 to the deasphalting reactor or series of reactors 1 operating at slightly undercritical conditions. The heavy fraction from 1, formed of asphaltenes and/or resins with some solvent, is discharged through line 19, heated in exchanger 16, and passed to the solvent recovery step 20 via line 41 consisting of a low pressure flash followed with a final stripping with steam. Asphalt is recovered therefrom at 32. The light fraction from 1, comprising deasphalted oil and the major part of the solvent (about 90%) is discharged through line 2 and heated in exchangers 3 and 4 so as to reach supercritical conditions. The mixture, at that time diphasic, settles in separator 5.

The light phase from 5, comprising at least 92.5% by weight of solvent and mostly at least 97.5% by weight of solvent, is discharged through line 6. It transfers heat to the oil-solvent mixture in exchanger 3. At the output of exchanger 3, this mixture is usually still slightly "supercritical" with respect to the solvent: the pressure is substantially higher than the critical pressure and the temperature is a few degrees higher than the critical temperature. In these conditions, the supercritical fluid has the characteristics of a liquid and may be pumped through pump 7 into the solvent tank 21.

The heavy phase from 5, consisting essentially of oil (at least 50% by weight and mostly at least 70% by weight of oil) is discharged through line 9 and heated in furnace 10. This mixture, at that time diphasic, settles in separator 11.

The light phase from 11, comprising a minimum of 97.5% of pure solvent, is discharged through line 15, cooled in exchanger (16), pumped through pump 17 and fed to the solvent tank 21 through line 18. The solvent, separated under supercritical conditions, passing through tank 21, amounts to at least 83.5% of the total solvent and, mostly at least 89% of the total solvent.

The heavy phase from 11, formed of oil (a minimum of 83% by weight and up to 96%) is discharged through line 12; it transfers heat to the oil-solvent mixture through exchanger 4 before reaching, through line 13, a recovery stage 14 consisting of a low pressure flash and a final stripping with steam. The solvent recovered in steps 14 and 20 is fed back to the tank of cold solvent 24, respectively through lines 22 and 23 and then joins the input line of hot solvent 8 through line 25. Deasphalted oil flows out from 14 through line 31.

FIG. 2 illustrates the two-stage supercritical separation combined with a recompression of supercritical fluid.

The heavy charge is supplied through line 26 to the deasphalting reactor or series of reactors 1 to which the solvent is fed through line 27. The mixture of asphalt with some solvent forming the heavy fraction is conveyed from 1 through line 19 to exchanger 16 where it is heated before admission to the separation stage 20 consisting of a low pressure flash and a stripping with steam. The light fraction from 1, consisting of deasphalted oil and of the major part of the solvent, is heated in exchangers 3 and 4. At the output of exchanger 4, the obtained diphasic mixture settles in separator 5.

The light fraction from separator 5, comprising at least 92.5% by weight of solvent and mostly at least 97.5% of solvent, is discharged through line 6 towards compressor 28, so as to increase its temperature by at least 15° C. The heated solvent is conveyed through line 29 to exchanger 3, where it transfers heat to the solvent-oil mixture and then towards expansion valve 30 (optionally towards a turbine to recover mechanical power) where the solvent expands and liquefies while being brought back to a temperature lower than the critical temperature. Line 44 conveys the solvent to tank 21.

The heavy fraction from separator 5, comprising at least 50% by weight of oil and mostly at least 70% of oil, is conveyed through line 9 to furnace 10 where it is heated. The diphasic mixture settles in separator 11.

The light phase from separator 11, comprising at least 97.5% of solvent, is conveyed through line 15 to exchanger 16, where it transfers heat to the heavy phase of the deasphalting stage and then is fed back, through pump 17, to the solvent tank 21. At least 85% of the solvent passes through tank 21.

The heavy phase from separator 11, comprising at least 85% of oil, transfers heat to the oil-solvent mixture in exchanger (4) and is then fed, through line 13, to the solvent separation stage (14), consisting of low pressure flash and stripping with steam. The cold solvent recovered from stages 14 and 20 is fed back through lines 22 and 23 to tank 24 and then, through line 25, to the solvent feed line 27.

FIG. 3 illustrates a preferred embodiment of the invention wherein the solvent ratio (volume ratio of the solvent to the charge) is higher than 8. It comprises a first supercritical separation, followed with a second supercritical separation for each of the two separated phases.

The residue is supplied through line 26 and solvent through line 27 to the deasphalting reactor or series of reactors 1 operating under slightly undercritical conditions. The heavy fraction, consisting of asphaltenes and/or resins together with some solvent, is discharged through line 19 towards zone 20 consisting of a low pressure flash and a final stripping with steam. The light fraction from 1, consisting of deasphalted oil and the major part of the solvent (about 95%) is discharged through line 2, heated in exchanger 3 and admixed at the junction 33 with the hot effluent from line 42. The resultant diphasic mixture is subjected to supercritical separation in separator 5.

The light phase from separator 5, comprising at least 92.5% by weight of solvent, is discharged through line 6, heated in exchanger 34, admixed with the hot effluent from line 15 at the junction 35 and undergoes a new supercritical separation in separator 36.

The light phase (comprising at least 97.5% by weight of solvent) flowing out from separator 36 is fed through line 37 to exchanger 3 where it is cooled, and conveyed through pump 7 to the solvent tank 21 through line 38 (in these conditions, the supercritical fluid has a compressibility close to that of a liquid).

The heavy phase issued from separator 36 is pumped at 39 through line 42 towards junction 33 and separator 5.

The heavy phase from 5, comprising a substantial part of oil (at least 40% by weight) is discharged through line 9 and heated in furnace 10. The resultant diphasic mixture settles in separator 11.

The light phase from separator 11, comprising a minimum of 97.5% by weight of pure solvent, is discharged through line 15 towards junction 35.

The heavy phase from separator 11, consisting of oil (a minimum of 87% and up to 96%) is discharged through line 12 to exchanger 34 where it is cooled before being supplied via a conduit 43 to zone 14 consisting of a low pressure flash and a final stripping with steam. The deasphalted oil is recovered through line 31.

From zone 14, the recovered cold solvent is fed to the cold solvent tank 24. From zone 20 the recovered cold solvent is fed to tank 24. From the hot solvent tank 21 and the cold solvent tank, lines 8 and 25 join with line 27.

EXAMPLES

The following examples are given to illustrate the invention but must not be considered as limiting in any way the scope thereof.

The seven following examples show the interest of the invention and the corresponding progress with respect to the prior art.

Example 1 is an application of the prior art according to the principle disclosed in U.S. Pat. No. 2,940,920 and of step (a) of the present invention as practically operated.

Example 2 illustrates an application of the invention by combination of steps (a) and (b1).

Example 3 illustrates the preferred way of application of the invention, by combination of steps (a) and (b3).

In the three preceding examples, the operation is conducted with the same solvent, consisting of a pentane cut, and with the same flow rates of charge and solvent as in the deasphalting step. Table 3 gives comparative indications in order to estimate the advantages of the various embodiments of the invention (examples 2 and 3) over a particular application of the prior art.

Example 4 illustrates the preferred embodiment of the invention when the solvent ratio is at least equal to 8. This test is conducted with the same charge and the same solvent as in the four preceding examples, but the solvent rate, which was 3.75 in examples 1 to 3, is now equal to 9.6.

Example 5 illustrates the preferred embodiment of the invention combining steps (a) and (b3) when the deasphalting solvent is butane and the solvent ratio is lower than 8.

Example 6 illustrates the preferred embodiment of the invention, combining steps (a) and (b3), when the deasphalting solvent is propane and the solvent ratio is lower than 8.

EXAMPLE 1 (FIG. 4: prior art)

3 t/h of vacuum residue (whose characteristics are given in table 1) are introduced through line 26 and 7 t/h of pentane cut (whose characteristics are given in table 2) through line 27 in a mixing zone followed with a settling zone 1, whose assembly is called a deasphalting zone. In said zone the average temperature is 190° C. and the pressure 46 absolute bars. In these conditions, the mixture settles in two phases. 8.3 t/h of light phase, consisting of a mixture of 24.1% by weight of deasphalted oil with 75.9% by weight of solvent, are withdrawn from line 2. A mixture consisting of 58.8% of asphalt and 41.2% of solvent is withdrawn from line 19 at a rate of 1.7 t/h. The asphalt-solvent mixture is flashed at low pressure and then stripped with steam in zone 20. From said zone are recovered 1 t/h of asphalt and 0.7 t/h of solvent which is fed back through line 23 to line 27. The deasphalted oil-solvent mixture from line 2 passes through exchanger 3 where its temperature is increased to 224° C. At the output of said exchanger, a fraction of the mixture has already "vaporized". This mixture is further heated in furnace 40 so as to bring its temperature to 245° C. In a settling zone 50, maintained at 45 absolute bars, the diphasic mixture is allowed to settle. 2.73 t/h of a liquid, consisting of 72.5% deasphalted oil and 27.5% solvent, are withdrawn through line 9. The oil-solvent mixture is conveyed to zone 14 where it is flashed at low pressure and then stripped with steam. From said zone are discharged 2 t/h of deasphalted oil (31) and 0.752 t/h of solvent which is fed back, through line 22, towards line 27. From line 6, extending from separator 5, are withdrawn 5.57 t/h of supercritical fluid containing 0.4% of oil and 99.6% of solvent. This fluid is cooled in exchanger 3 and flows out therefrom at a temperature of 205° C. Pump (7) conveys this fluid, whose compressibility and density characteristics are close to those of a liquid, towards buffer tank 21. Through line 8, this fluid is fed back to line 26.

TABLE 1

| Vacuum residue | |
|---|---|
| $d_4^{15}$ = 0.981 | |
| Viscosity at 100° C. = | 158 cSt |
| Initial boiling point = | 400° C. |
| Distilled % at 500° C. = | 7% vol. |
| Molecular weight (tonometry) = | 780 |

TABLE 2

| Characteristics of $C_5$ cut |
|---|
| $d_4^{15}$ = 0.6245 |
| $C_2H_6$: 0.1%, $C_3H_8$: 0.15%, $C_4H_{10}$: 0.2%, $nC_5H_{12}$: 78.97% |
| $iC_5H_{12}$: 20.3%, $C_6H_{14}$: 0.28% |

EXAMPLE 2 (FIG. 1)

3 t/h of vacuum residue (of characteristics equivalent to those of example 1) are introduced through line 26 and 7 t/h of pentane cut (of characteristics equivalent to those of example 1) are introduced through line 27 into a mixing zone followed with a settling zone, forming together a so-called deasphalting zone. In said zone, the average temperature is 190° C. and the pressure 46 absolute bars. In these conditions the mixture settles in two phases. A light phase consisting of a mixture of 24.1% by weight of deasphalted oil with 75.9% of solvent is withdrawn through line 2 at a rate of 8.3 t/h. A mixture containing 58.8% of asphalt and 41.2% of solvent is withdrawn through line 19 at a rate of 1.7 t/h. The asphalt-solvent mixture passes through exchanger 16 and flows out therefrom at 204° C., then reaches zone 20 where it is flashed at low pressure and stripped with steam. The effluents from zone 20 consist of 1 t/h of asphalt and 0.7 t/h of solvent fed back to line 27 through line 23. The deasphalted oil-solvent mixture from line 2 then passes through exchanger 3 wherefrom it is discharged at 224° C. Then it passes through exchanger 4 wherefrom the mixture flows out at 245° C.; as a result of the pressure drop the pressure is 45 absolute bars. The mixture settles in two phases in separator 5, fed through line 2.

A light phase containing 0.4% of oil and 99.6% of solvent is discharged from separator 5 through line 6 at a rate of 5.57 t/h and fed to exchanger 3 where the temperature of this supercritical fluid decreases to 205° C.; the pressure is then 44 bars. This fluid is taken again through pump 7 and fed to the storage tank 21 (temperature: 205° C., pressure: 46 bars).

A heavy phase containing 27.5% of solvent and 72.5% of oil is fed at a rate of 2.73 t/h through line 9 from separator 5 to furnace 10 where the temperature increases up to 285° C. This mixture then settles in separator 11 where the pressure is about 44 bars.

A mixture containing 0.37% of oil and 99.63% of solvent is withdrawn through line 15 at a rate of 0.459 t/h; this mixture is cooled to 205° C. in exchanger 16 and supplied through line 18 to pump 17 wherefrom it is fed to the solvent tank 21.

A mixture containing 13% of solvent and 87% of oil is withdrawn from separator 11 through line 12 and cooled to 235° C. in exchanger 4, wherefrom it is conveyed through line 13 to zone 14 where it is flashed at low pressure and stripped with steam.

The effluents from said zone consist of 1.976 t/h of deasphalted oil, discharged through line 31 and 0.295 t/h of solvent conveyed through line 22 towards line 27.

EXAMPLE 3 (FIG. 2)

The vacuum residue and the pentane cut of examples 1 and 2 are fed, respectively through lines 26 and 27, (at respective rates of 3 t/h and 7 t/h) to the mixing zone followed with the settling zone, forming together the so-called deasphalting zone, where the operating conditions are 190° C. and 46 bars.

A mixture containing 24.1% (b.w.) of oil and 75.9% of solvent is withdrawn therefrom through line 2 at a rate of 8.3 t/h. A mixture containing 58.8% of asphalt and 41.2% of solvent is withdrawn at a rate of 1.7 t/h through line 19, then heated to 203° C. in exchanger 16 and fed to zone 20 where it is flashed at low pressure and stripped with stream. The effluents from zone 20 consist of 1 t/h of asphalt discharged through line 32 and 0.7 t/h of solvent, fed back to line 27 through line 23. The oil-solvent mixture flowing out from deasphalting zone 1 through line 2 is heated to 230° C. in exchanger 3 and then to 245° C. in exchanger 4, the prevailing pressure being then 45 absolute bars. The diphasic mixture settles in separator 5. From line 9 are withdrawn 2.73 t/h of liquid containing 72.5% by weight of oil and 27.5% of solvent: This effluent is heated to 280° C. in furnace 10 and settles in separator 11 (280° C., 44 bars) giving again 2 phases. A liquid phase containing 85% of oil and 15% of solvent is withdrawn therefrom through line 12 at a rate of 2.328 t/h. It is then cooled in exchanger 4 and fed, through line 13, to zone 14 where it is flashed at low pressure and stripped with steam. The effluents from zone 14 consist of 1.976 t/h of deasphalted oil and 0.352 t/h of solvent conveyed through line 32 towards line 27. From separator 11, supercritical fluid, containing 99.60% of solvent and 0.4% of oil flows out through line 15 at a rate of 0.402 t/h. It is cooled to 205° C. in exchanger 16 and fed, through line 18, to pump 17 where it is compressed to 46 bars and supplied to tank 21.

A mixture containing 99.6% of solvent and 0.4% of oil flows out from separator 5 through line 6 at a rate of 5.57 t/h. This supercritical fluid passes through compressor 28 where its pressure is increased to 58 bars. The compression being adiabatic, the temperature increases to 262° C. The fluid is then cooled to 205° C. in exchanger 3 and passes through zone 30, consisting either of an expansion valve or of a turbine, to recover mechanical power. The expansion to 46 bars results in cooling to 189° C. The solvent is then fed to tank 21 where it is stored at 190° C. and 46 bars.

Table 3 shows the results obtained in examples 1 to 3 which are comparable withone another and the result of example 4 which is not comparable as concerns power.

It appears that in examples 2 and 3 a substantial saving of thermal power is obtained as compared to example 1 and, in addition, that the purity of the deasphalted oil is substantially higher (or the solvent content lower). Example 4 relates particularly to deasphalting processes whose basic step, i.e. the deasphalted oil-asphalt separation (1) requires high solvent ratios. The power saving achieved according to example 4, as compared to example 1 with a triple solvent amount, is about 23%.

The advantage resulting from the greater purity of the oil will be expressed in terms of stripping steam expense, this item being substantially proportional to the amount of residual solvent to withdraw. In examples 2, 3 and 4 the oil purity is substantially higher than in the prior art.

COMPARISON OF THE VARIOUS EMBODIMENTS

TABLE 3

| | SOLVENT | | | OIL | | | ASPHALT | THERMAL POWER |
|---|---|---|---|---|---|---|---|---|
| | D (t/h) | t° C. | Purity | D (t/h) | T° C. | Purity | T° C. | (arbitrary unit) |
| Ex. 1 | 5.57 | 205 | 99.6% | 2.73 | 245 | 72.5% | 190 | 100 |
| Ex. 2 | 6.03 | 205 | 99.6% | 2.27 | 235 | 87% | 204 | 80.5 |
| Ex. 3 | 5.97 | 190 | 99.6% | 2.33 | 240 | 85% | 203 | 70 |
| Ex. 4 | 17.31 | 205 | 99.6% | 2.31 | 240 | 93.1% | 190 | 77* |

*With respect to the performance of example 1 with a triple solvent amount.

EXAMPLE 4 (FIG. 3)

Vacuum residue identical to that of examples 1 to 3 is introduced through line 26 at a rate of 3 t/h and a pentane cut identical to that of examples 1 to 3 is introduced at a rate of 18 t/h through line 27 together with 0.067 t/h of deasphalted oil recycled with solvent.*

* The amount of deasphalted oil stripped with the recycled solvent in examples 1 to 3 being very low (about 0.02 t/h), has not been mentioned in the description of examples 1 to 3.

Lines 26 and 27 feed the mixing zone followed with a settling zone forming together a so-called deasphalting zone 1. In said zone the average temperature is 190° C. and the pressure 49 absolute bars. In these conditions the mixture settles into two phases. A light phase containing 11% by weight of deasphalted oil and 89% of solvent is withdrawn from 1 through line 2 at a rate of 19.617 t/h.

A mixture (1.45 t/h) containing 58.8% by weight of asphalt and 41.2% of solvent is withdrawn from 1 through line 19. The asphalt-solvent mixture is then flashed at low pressure and stripped with steam in zone 20. The effluents from said zone consist of 0.85 t/h of asphalt, discharged through line 32, and 0.60 t/h of cold solvent which is fed back through line 23 to tank 24 and then line 27.

The deasphalted oil-solvent mixture from line 2 passes through exchanger 3 and flows out therefrom at 224.5° C. A mixture containing 72.4% by weight of oil is added thereto at a rate of 0.22 t/h at junction 33. After this addition, the temperature of the resultant mixture is 224.75° C. and two phases are present. The mixture settles in separator 5 where the conditions are 224.75° C. and 48 absolute bars.

A heavy phase containing 39.26% by weight of oil and 60.74% of solvent is withdrawn from separator 5 through line 9 at a rate of 5.946 t/h. It is heated to 300° C. in furnace 10, wherefrom it flows out again as a diphasic mixture which settles in separator 11 where the pressure is 47 absolute bars. A heavy phase containing 93.07% of oil and 6.93% of solvent is then withdrawn from separator 11 through line 12 at a rate of 2.31 t/h. This heavy phase is cooled to 240° C. in exchanger 34 wherefrom it is conveyed to zone 14 where it is flashed at low pressure and stripped with steam. The effluents from said zone consist of 2.15 t/h of deasphalted oil and 0.16 t/h of cold solvent which is fed back through line 22 to tank 24. From separator 11, a flow of 3.186 t/h of solvent containing 0.25% of oil is withdrawn through line 15 and supplied to junction 35.

A light phase containing 1.52% by weight of oil and 98.48% by weight of solvent is withdrawn from the top of separator 5, at a rate of 14.34 t/h. This flow is heated from 224.75° C. to 231.35° C. in exchanger 34. During this heating, the steam, initially at its dew point, recondenses a small amount of mixture of high oil content, this phenomenon being called retrograde condensation. The 3.186 t/h flow from line 15 are then added at junction 35. After this addition the temperature of the whole mixture reached 245° C. and an additional oil amount was condensed.

From separator 36, where the pressure is 46.5 absolute bars, 0.22 t/h of heavy phase containing about 72% by weight of oil and 28% of solvent are further recovered. This effluent is conveyed through pump 39 and line 42 to junction 33.

17.307 t/h of solvent containing 0.38% of oil are withdrawn from the top of separator 36, through line 37. This solvent is cooled to 205° C. in exchanger 3 before being supplied by pump 7, through line 38, to the hot solvent tank 21.

Lines 8 and 25 convey the hot solvent and the cold solvent back to line 27.

EXAMPLE 5 (FIG. 2)

3 t/h of the same vacuum residue as in example 1 are treated with 12 t/h of a $C_4$ cut at 110° C. and 57 absolute bars. The extract is settled at 175° C. and 55 absolute bars (first step) by removing 93.3% of the solvent and theremaining heavy phase is fed to a second separator at 215° C. and 54 bars (second step) wherefrom are separated 73% of the solvent remaining in the heavy phase after the first step.

The effluent from line 6 is compressed to 75 bars and consequently heated to 195° C. It transfers heat in exchanger 3 before passing through the valve or the turbine 30. The oil flowing through line 12 transfers heat in exchanger 4. After final flash and stripping with steam, 1.8 t/h of deasphalted oil are recovered.

EXAMPLE 6 (FIG. 2)

3 t/h of the same vacuum residue as in example 1 are treated with 18 t/h of $C_3$ cut at 75° C. and 45 absolute bars. The extract is compressed before settling at 123° C. and 73 bars (first step). 95.4% of the solvent are thus removed. The remaining heavy phase passes through a second separator at 163° C. and 72 bars, wherefrom are removed 75.4% of the solvent remaining in the heavy phase after the first step.

The effluent from line 6 is compressed to 100 bars and consequently heated to 128° C. It transfers heat in exchanger 3 before passing through the valve or the turbine 30.

The oil flowing through line 12 transfers heat in exchanger 4. After a final flash and stripping with steam, 1.7 t/h of deasphalted oil are recovered.

What is claimed as the invention:

1. In a deasphalting process, wherein an asphalt-containing oil is subjected to extraction by means of a solvent selected from hydrocarbons having 3 to 6 carbon atoms and mixtures thereof, an oil phase of raw extract and an asphalt phase of raw raffinate are separately recovered and solvent is separated from each of said phases, the improvement in the solvent separation comprising:

(a) in a first step, heating said oily phase of raw extract to a temperature $T_1$ at a pressure $P_1$ which together are supercritical with respect to the solvent, so as to settle said oily phase into two phases, respectively a first phase of recovered solvent and a first extract phase of increased oil content and decreased solvent content, and separating said settled two phases from each other, and (b) in a second step, heating said first extract phase of increased oil content and decreased solvent content separated in the first step to a temperature $T_2$ at a pressure $P_2$ which together are supercritical with respect to the solvent, so as to settle said first extract phase into two phases, respectively a second phase of recovered solvent and a second extract phase of increased oil content, and separating said settled two phases from each other, and recycling said first phase and said second phase of recovered solvent to said extraction, wherein at least a portion of the heat supplied to said first extract phase in the second step is heat of external origin, and at least a portion of the heat supplied to said oily phase of raw extract in the first step is supplied by a heat exchange with said first phase of recovered solvent before recycle thereof to said extraction and a heat exchange with said second extract phase of increased oil content, $T_1$, $T_2$, $P_1$ and $P_2$ being defined as follows:

$$Tc+1.5\ x_2-2x<T_1<Tc+1.5\ x^2-2x+45$$

$$T_1+2-<T_2<T_1+80$$

$$Pc+5<P_1<Pc+30$$

$$Pc<P_2<P_1+20$$

wherein Tc and Pc are respectively the critical temperatures and the critical pressure of the solvent, the temperatures being expressed in celsius degrees and the pressures in bars, and x is the average number of carbon atoms of the solvent molecule, the second extract phase of increased oil content forming the desired deasphalted oil wherefrom residual solvent, when present, can be separated.

2. A process according to claim 1, wherein the first phase of recovered solvent is recompressed under at least partially adiabatic conditions, said supply of heat from the recompression of the first phase of recovered solvent being transferred to said oily phase.

3. A process according to claim 1, wherein at least part of the sensible heat of the second extract phase of increased oil content is transferred by heat exchange to the oily phase of raw extract after said oily phase has received heat from the first phase of recovered solvent and before separation of the two phases settled in said first step.

4. A process according to claim 1, wherein the temperature and pressure conditions are such that, in the first step, the first phase of recovered solvent comprises at most 7.5% by weight of deasphalted oil and at least 92.5% by weight of solvent and the first extract phase of increased oil content comprises at least 40% by weight of deasphalted oil and at most 60% by weight of solvent.

5. A process according to claim 4, wherein the first phase of recovered solvent comprises at most 2.5% by weight of deasphalted oil and at least 97.5% by weight of solvent, and the first extract phase of increased oil content comprises at least 70% by weight of deasphalted oil and at most 30% by weight of solvent.

6. A process according to claim 1, wherein the temperature $T_1$ and the pressure $P_1$ together are supercritical with respect to the oily phase of raw extract, comprising supplying heat to said first phase of recovered solvent by heat exchange with said second extract phase of increased oil content, so as to settle said first phase of recovered solvent, by retrograde condensation, to a third phase of recovered solvent and a third extract phase of increased oil content, separating said settled phases, transferring sensible heat of said third phase of recovered solvent to the oily phase of raw extract and admixing said third extract phase of increased oil content with the oily phase of raw extract for settling therewith in the first step.

7. A process according to claim 2, wherein the first phase of covered solvent is recompressed so as to increase its temperature by at least 15° C., and subjected to heat exchange with said oily phase.

8. A process according to claim 1, wherein 75 to 97% of the solvent contained in the oily phase of raw extract is separated in the first step and 50 to 80% of the solvent contained in the first extract phase of increased oil content is separated in the second step.

9. A process according to claim 1, where at least part of the sensible heat of the second phase of recovered solvent is transferred by heat exchange to said asphalt phase of raw raffinate before recycling of said solvent to the first step.

* * * * *